US007107927B2

(12) United States Patent
Hopper et al.

(10) Patent No.: US 7,107,927 B2
(45) Date of Patent: Sep. 19, 2006

(54) FOLDING DECK

(75) Inventors: Randy W. Hopper, Flippin, AR (US); Ken Poley, Yellville, AR (US)

(73) Assignee: Wood Manufacturing Company, Inc., Flippin, AR (US)

( * ) Notice: Subject to any disclaimer, the term of this patent is extended or adjusted under 35 U.S.C. 154(b) by 0 days.

(21) Appl. No.: 10/976,172

(22) Filed: Oct. 28, 2004

(65) Prior Publication Data

US 2006/0090688 A1 May 4, 2006

(51) Int. Cl.
*B63B 5/06* (2006.01)
*B63B 19/14* (2006.01)

(52) U.S. Cl. ..... 114/364; 114/363; 114/85

(58) Field of Classification Search ..... 114/85, 114/201 R, 202, 343, 361, 363, 364
See application file for complete search history.

(56) References Cited

U.S. PATENT DOCUMENTS

| | | | | | |
|---|---|---|---|---|---|
| 2,472,185 | A | | 6/1949 | Apel | |
| 3,052,896 | A | * | 9/1962 | Beach | 114/362 |
| 3,475,773 | A | * | 11/1969 | Codman, Jr. | 114/361 |
| 4,092,754 | A | * | 6/1978 | Yost | 114/361 |
| 4,293,967 | A | * | 10/1981 | Ord | 114/362 |
| 4,567,845 | A | * | 2/1986 | Smith | 114/363 |
| 4,714,043 | A | | 12/1987 | Sheppard | |
| 4,738,217 | A | | 4/1988 | Smith | |
| 4,763,598 | A | * | 8/1988 | Spencer | 114/361 |
| 4,827,864 | A | * | 5/1989 | LaMontagne et al. | 114/343 |
| 4,873,935 | A | | 10/1989 | Lustig | |
| 4,922,849 | A | * | 5/1990 | Wills | 114/361 |
| 4,960,066 | A | * | 10/1990 | Wills | 114/361 |
| 4,979,458 | A | | 12/1990 | Bouza | |
| 5,014,370 | A | | 5/1991 | Stark, Sr. | |
| 5,170,741 | A | * | 12/1992 | Magers et al. | 114/364 |
| D332,935 | S | | 2/1993 | Moore | |
| 5,189,977 | A | * | 3/1993 | Davidson | 114/201 R |
| 5,197,406 | A | | 3/1993 | Rabal et al. | |
| 5,375,552 | A | * | 12/1994 | Scott | 114/363 |
| 5,497,724 | A | | 3/1996 | Brown et al. | |
| 5,894,812 | A | * | 4/1999 | Dessingue | 114/361 |
| 5,913,571 | A | | 6/1999 | Dystra et al. | |
| 5,975,002 | A | * | 11/1999 | Rieger | 114/343 |
| 6,230,648 | B1 | | 5/2001 | Davidson et al. | |
| 6,283,059 | B1 | | 9/2001 | Scully, Jr. | |
| 6,497,192 | B1 | * | 12/2002 | Fecht | 114/363 |
| D483,715 | S | | 12/2003 | Montgomery | |
| D485,225 | S | | 1/2004 | Montgomery | |
| 6,945,190 | B1 | | 9/2005 | Frandsen | |

FOREIGN PATENT DOCUMENTS

| | | | |
|---|---|---|---|
| FR | 2201669 A | * | 5/1974 |
| JP | 02028091 A | * | 1/1990 |

OTHER PUBLICATIONS

"Whatever You Do on the Water, Do it in a Crestliner", 2002 Crestliner Boats catalog, front cover, pp. 8 and 9 and back cover (2001).

U.S. Appl. No. 10/976,345, filed Oct. 28, 2004.

* cited by examiner

*Primary Examiner*—Ajay Vasudeva
(74) *Attorney, Agent, or Firm*—Merchant & Gould P.C.

(57) ABSTRACT

A boat deck including a bow convertible between a flush deck and an open bow. The boat deck includes a removable deck portion positioned above a footwell forming a portion of the forward deck flush with the remainder of the deck. To convert to an open bow, the removable deck portion is removed from over the footwell and stowed along a forward bulkhead within the footwell.

6 Claims, 6 Drawing Sheets

FOLDING DECK

TECHNICAL FIELD

The present invention generally relates to boats decks, and more specifically relates to folding and stowable bow decks.

BACKGROUND

Many recreational boats are intended for a primary use, such as use as a fishing boat or as a runabout. Specialized deck arrangements for each of these uses differ, depending on where and what type of seats are most appropriate or desirable for the chosen activity. Configuration of a boat for one primary activity may decrease the boat's usefulness for a second activity. For example, a fishing boat may desirably have a raised front deck which serves as a casting platform and includes a leaning post or a raised pedestal seat. Such a front deck arrangement reducing the utility of the boat used as a runabout, such as for water skiing or other water sports. A boat configured for these activities may desirable include a front deck footwell with passenger seats on either side of the footwell.

Improvements to boat decks to permit multiple configurations for different activities are desirable.

SUMMARY

The present invention relates to a bow deck of a boat with a removable portion, where removal of the removable portion opens a footwell in the front deck. The present invention also relates to a method of converting a bow from a flush deck to a open bow configuration.

BRIEF DESCRIPTION OF THE DRAWINGS

The accompanying drawings, which are incorporated in and constitute a part of the description, illustrate several aspects of the invention and together with the detailed description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or similar parts.

Boats made for the recreational or pleasure craft industry may fall into two categories, which, though the hull shapes and characteristics are similar, have different deck layouts adapted for different purposes. These two categories are fishing or bass boats, and general purpose boats or runabouts. Fishing boats may more commonly have flush decks forming raised platforms in the bow, forward of the helm position, to provide a raised casting location for a person fishing from the bow. Runabouts may more commonly have an open-bowed, or bow rider configuration to the forward deck, with a central footwell and one or two seats extending along either side of the footwell. These seats along the footwell provide passenger seating locations forward of the helm, increasing the useful seating locations and passenger capacity of the boat.

Figure 1:
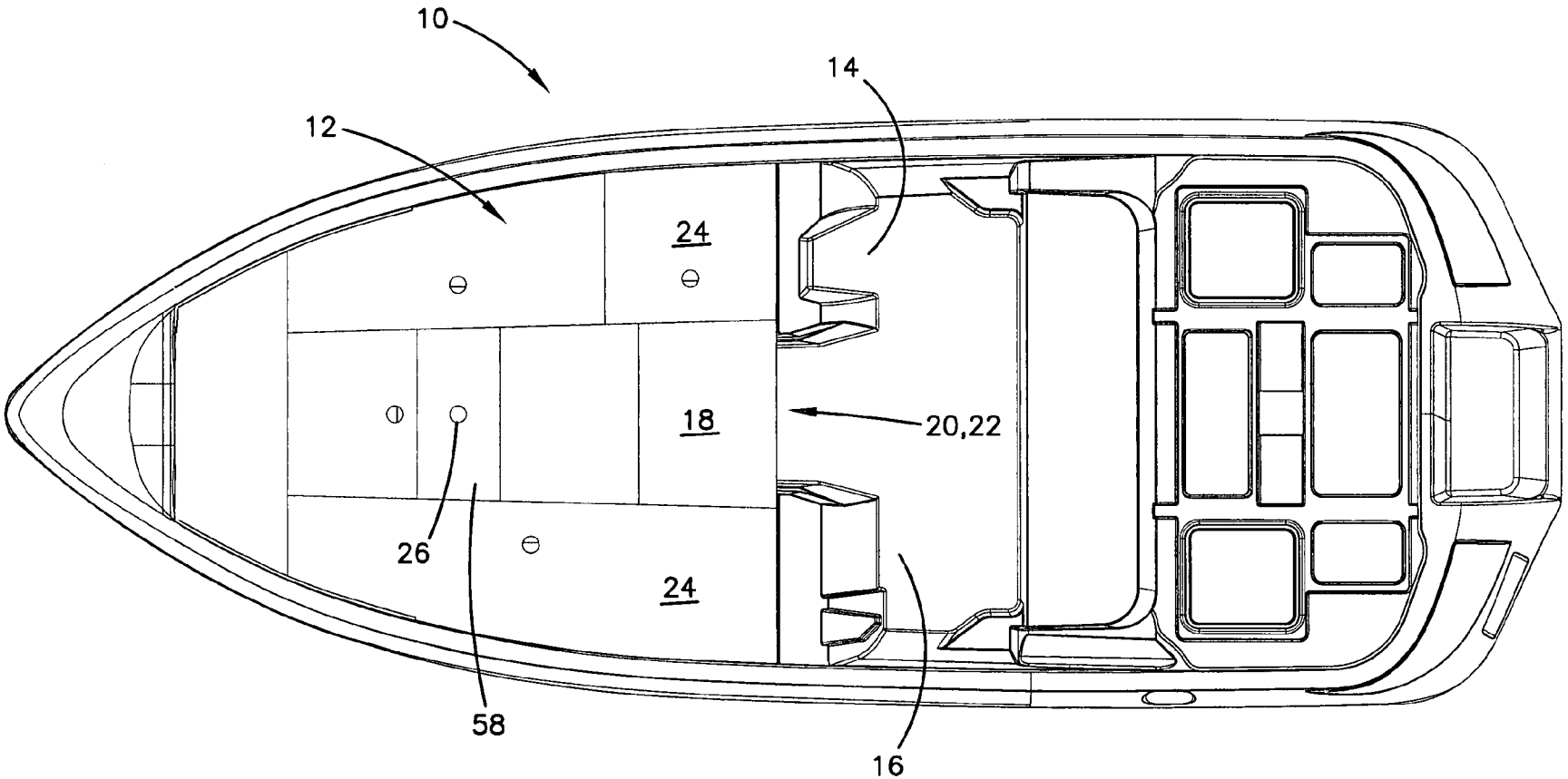
FIG. 1 is a top view of a boat including a removable deck portion according to the present invention.

As it has become desirable to have boats capable of serving as both fishing boats with raised forward casting platforms, and as runabouts with forward seating positions and a central footwell, a boat 10 may include a convertible bow deck 12, such as shown in FIG. 1. Boat 10 includes a helm location 14 and an adjacent passenger seat 16. Forward of helm 14 is bow deck 12. As shown, bow deck 12 includes a removable portion 18 positioned above and closing off a footwell 20 (seen more clearly in FIG. 2). Footwell 20 includes a rear open end 22 just forward of helm 14 and a pair of deck extensions 24 extending along either side. A forward seat mounting location 26 provides a location for mounting a raised seat or leaning post to provide a more stable casting position for a person fishing from bow deck 12. As shown in FIG. 1, bow deck 12 and side extensions 24 are generally flush with each other and provide a generally uniform deck surface for the person fishing from the forward casting position.

Figure 2:
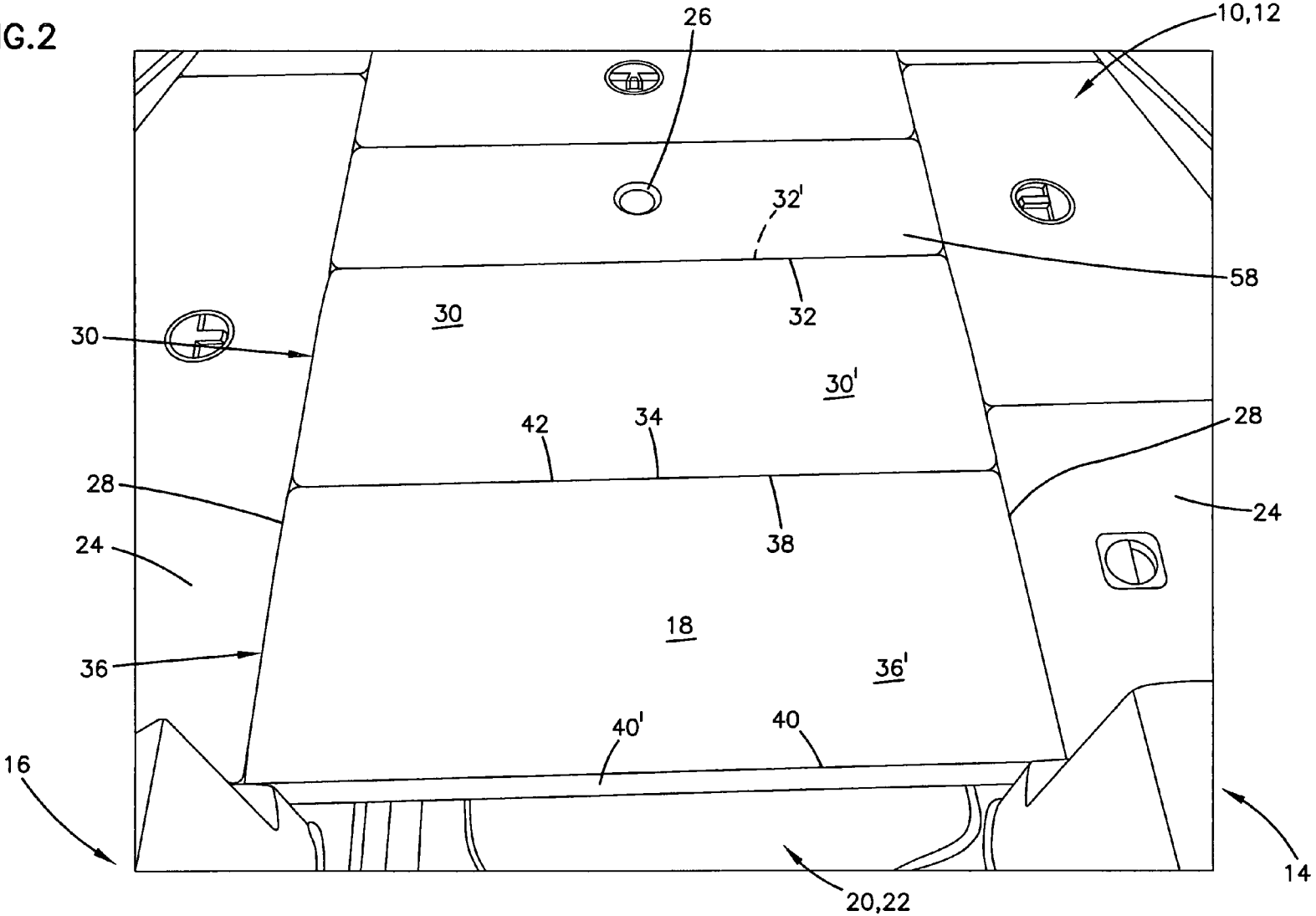
FIG. 2 is a rear perspective view of a bow of a boat including a removable deck portion according to the present invention.

FIG. 2 shows bow deck 12 and footwell 20 extending forward from open rear end 22 and accessible between helm 14 and passenger seat 16. Removable portion 18 is positioned above footwell 20 and extends from a first side 28 adjacent one side extension 24 to a second side 28 adjacent the other side extension 24. Removable portion 18 includes a forward element 30 with a front edge 32 and a hinge edge 34, and rear element 36 with a rear edge 40 and a hinge edge 38. The elements 30, 36 include major top surfaces 30', 36', and side surfaces 32', 34', 38' and 40' respectively positioned adjacent the edges 32, 34, 38 and 40. The two elements 30 and 36 are panels hingedly joined at a hinge line 42 between hinge edges 34 and 38 at a point which may be generally equidistant from the front and rear edges 32 and 40.

As shown in FIGS. 1 and 2, bow deck 12 includes a deck surface 58 positioned in front of footwell 20. The major surfaces 30', 36' of the removable portion 18 are generally flush with deck surface 58 when the removable portion 18 is positioned atop footwell 20. It is desirable to have a generally uniform height deck surface across bow deck 12 when bow deck 12 is in a fishing configuration, as shown in FIGS. 1 and 2.

Figure 3:
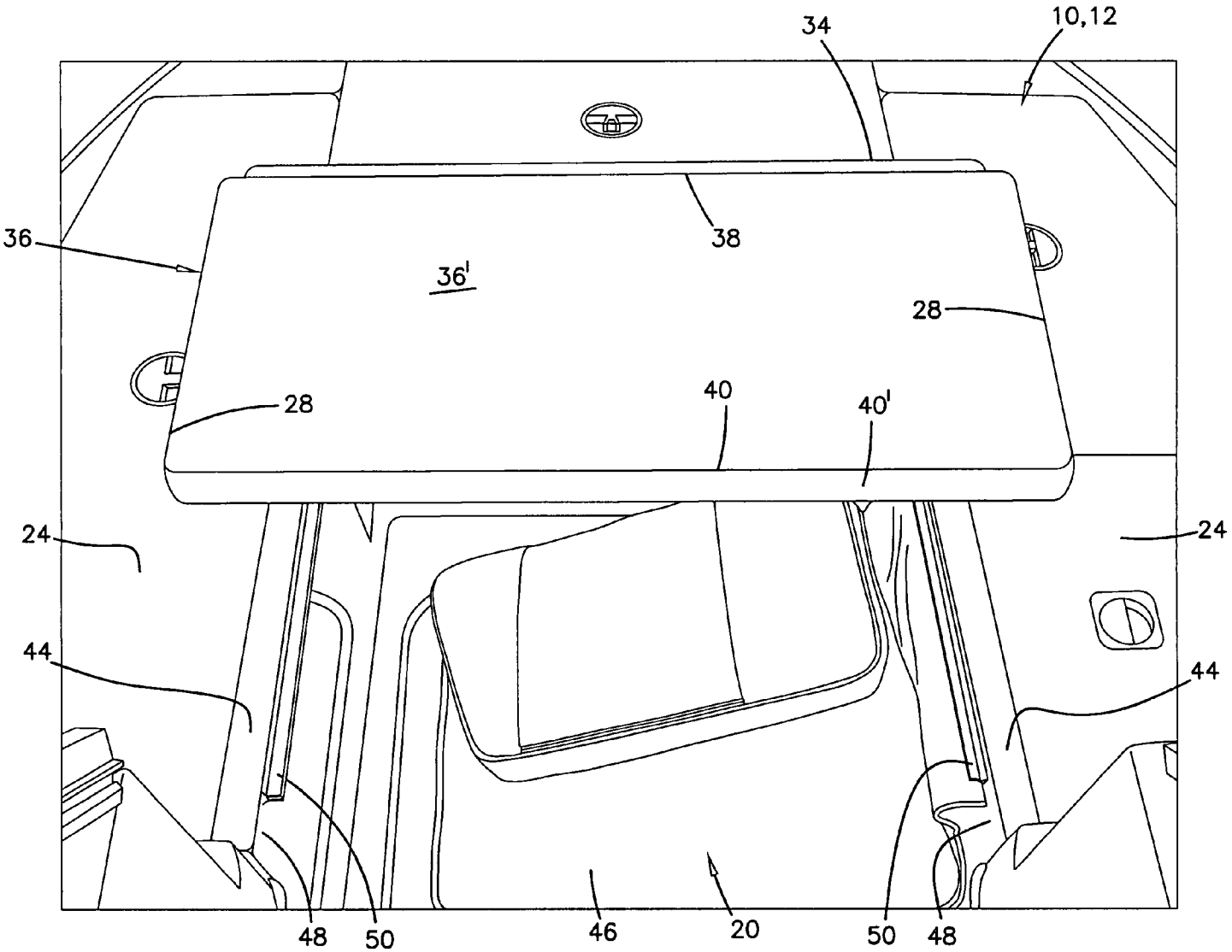
FIG. 3 is a rear perspective view of the bow of FIG. 2 with the removable portion partially removed from between two deck extensions on either side of a footwell in the bow.

In FIG. 3, removable portion 18 has been partially removed from atop footwell 20. Along each side extension 24 is an integral rail 44 on which sides 28 of removable extension 18 rest and are supported above footwell 20. Removable portion 18 has been folded along hinge line 42 as it has been removed from over footwell 20. Within footwell 20 beneath removable portion 18 can be seen a cushion arrangement 46, the use of which will be described below. Along an inner wall 48 on either side of footwell 20 is a cushion mounting slide 50, positioned adjacent one of the rails 44.

Figure 4:
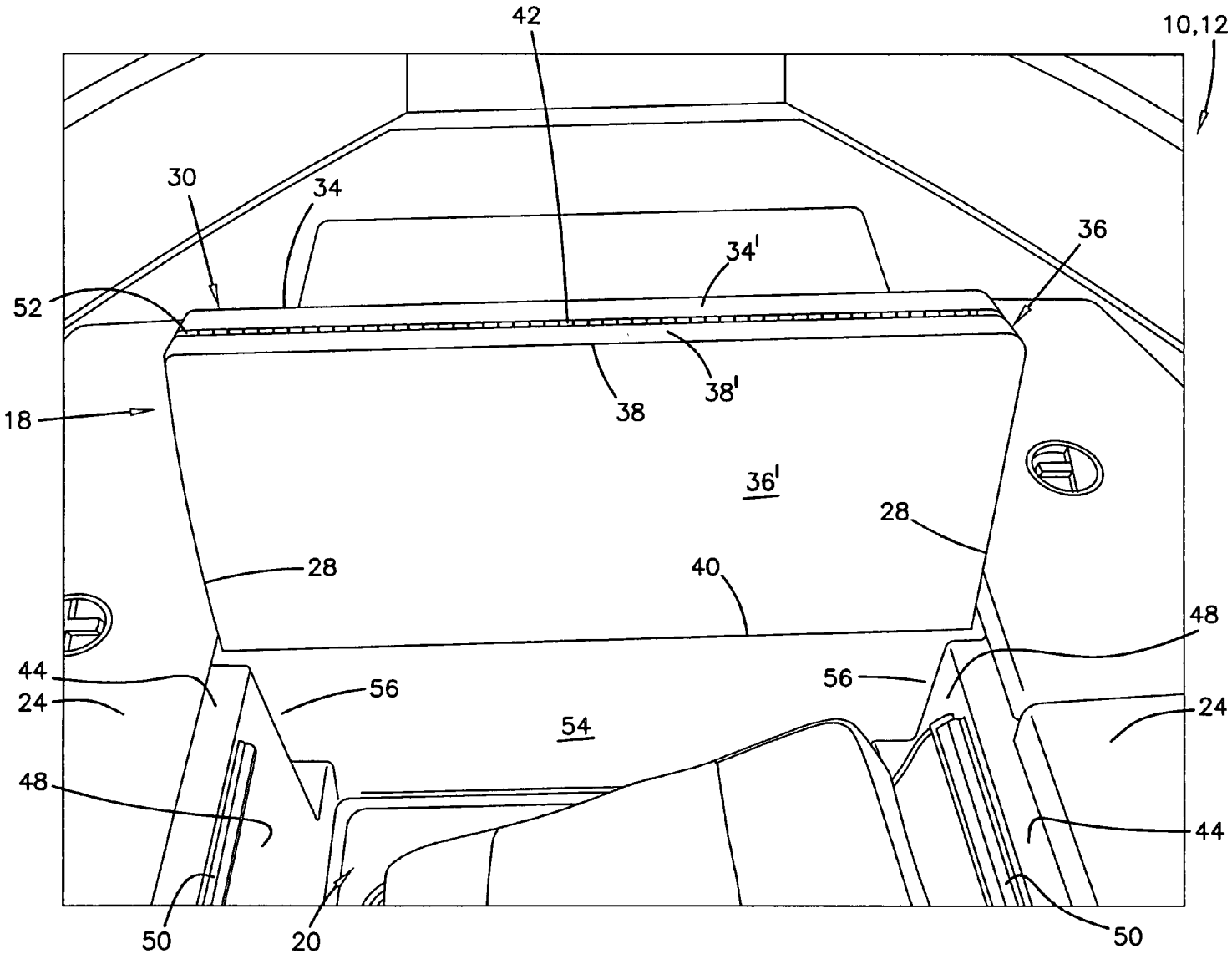
FIG. 4 is a rear perspective view of the bow of FIG. 2, with the removable deck portion folded along an intermediate hinge and positioned for insertion within a storage recess at a forward end within the footwell.

In FIG. 4, removable portion 18 has been folded in half along hinge line 42 with rear element 36 and front element 30 lying flat against one another. Along hinge line 42 can be seen a linearly arranged hinge or piano hinge 52. At a forward end 54 of footwell 20 are formed a pair of opposing slots 56 in inner walls 48. Slots 56 are sized to receive removable portion 18 when folded as shown in FIG. 4. Rails 44 and cushion mounting slides 50 terminate just astern of slots 56 to permit easy insertion or removal of removable portion 18 from slots 56.

Figure 5:
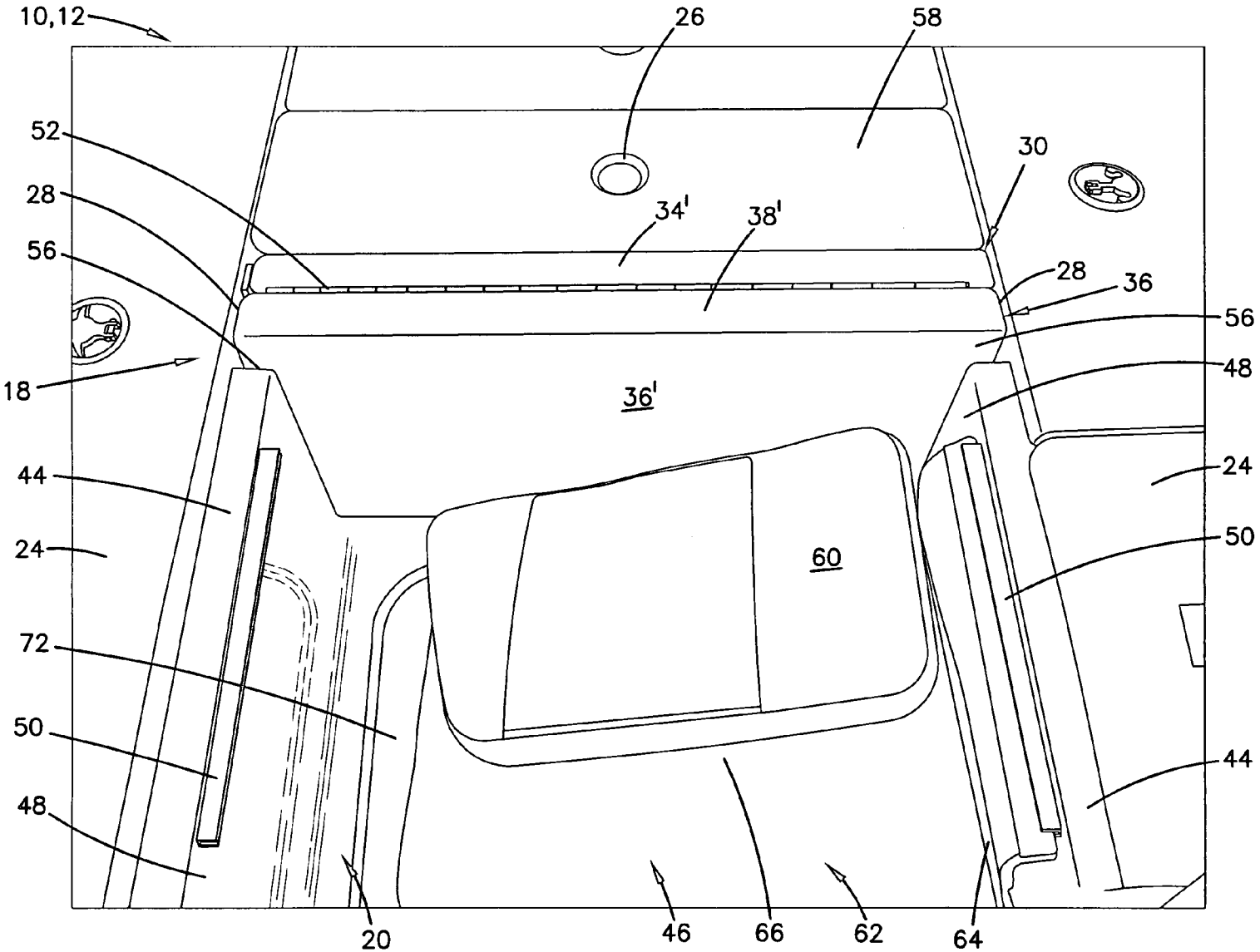
FIG. 5 is a rear perspective view of the bow of FIG. 2, with the removable deck portion stored within the recess at the forward end of the footwell and a seat cushion for one of the deck extensions folded and stored with the footwell.

FIG. 5 illustrates folded removable portion 18 in a stowed position within slots 56 at forward end 54 of footwell 20. Along hinge line 42, hinge edges 34 and 38 are at an upper edge of folded removable portion 18 and the side surfaces are generally flush with deck surface 58 of bow deck 12. Removable portion 18 as shown could be inserted into slots 56 with rear edge 40 and front edge 32 positioned upwardly and generally flush with deck surface 58. In the stowed position, the major surfaces 30', 36' of the folded removable portion 18 extend in a generally vertical orientation (see FIG. 5).

Within footwell 20 is cushion arrangement 46, including a forward cushion 60 and a rearward cushion 62 connected to cushion mounting slide 50 by a web 64. Forward cushion 60 is movably attached to rearward cushion 62 so that forward cushion 60 may be folded back along a backside 66 of rearward cushion 62, as shown in FIG. 5. Such a folding arrangement permits cushion arrangement 46 to extend further along bow deck 12, as the length of cushion arrangement 46 is not directly limited to a the length of footwell 20. A second cushion arrangement 46 may also be positioned within footwell 20 and attached to cushion mounting slide 50 on the other side 48. Web 64 allows one of the cushion arrangements to rest of the floor of footwell 20 without having to be detached from cushion mounting slide 50, and allowing the second cushion arrangement 46 on the opposite side to rest on top of the first cushion arrangement 46. Both cushion arrangements 46 are sized to be folded and fit beneath removable portion 18 when removable portion 18 is positioned on rails 44, as shown in FIGS. 1 and 2, above.

Figure 6:
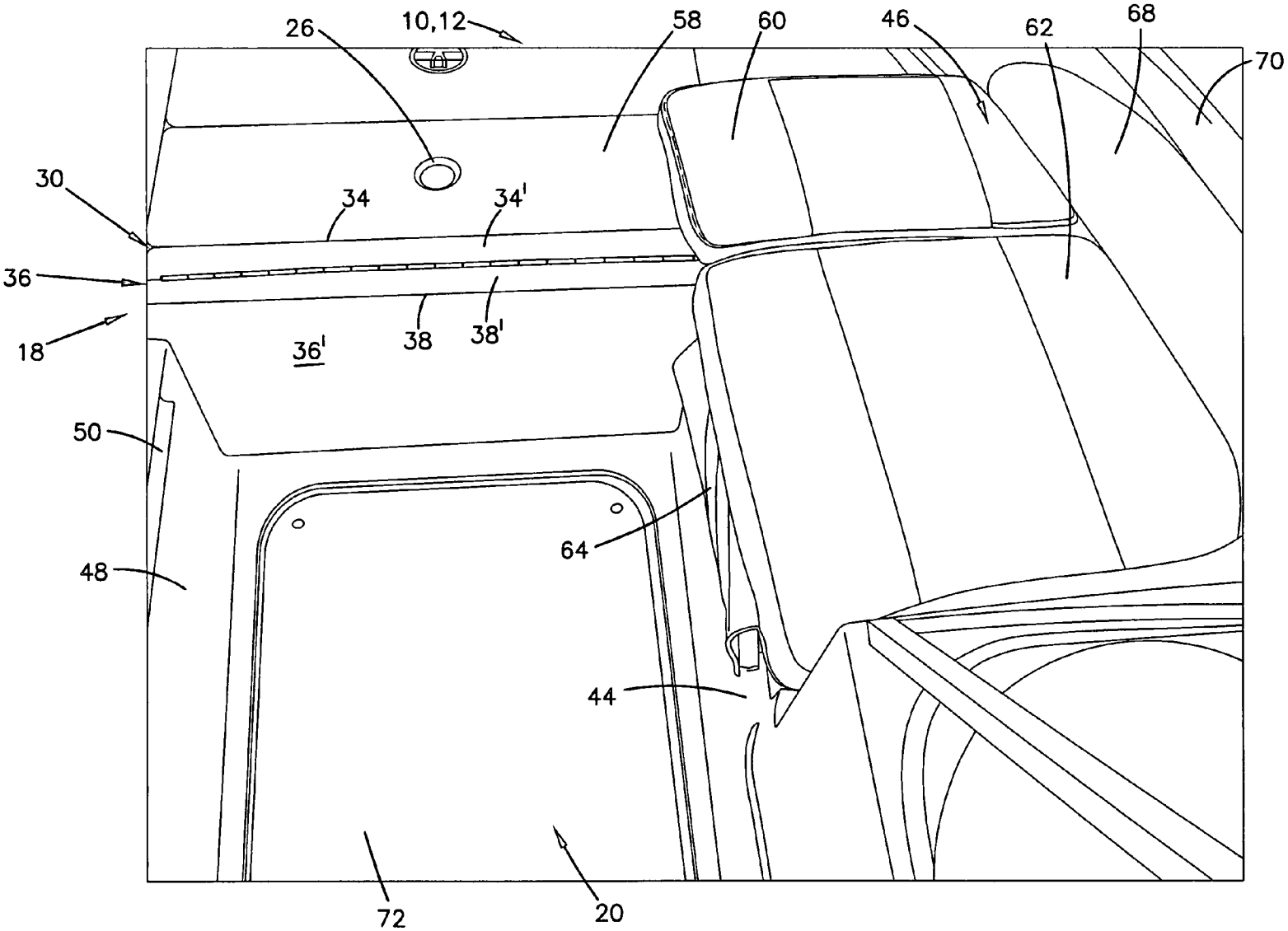
FIG. 6 is a rear perspective view of the bow of FIG. 2 with the seat cushion removed from the footwell, unfolded, and positioned atop one of the deck extensions.

When the removable portion 18 is stowed, the extensions 24 function as port and starboard seats (see FIG. 5). Cushions can be provided on the seats (see FIG. 6). FIG. 6 shows cushion arrangement 46 removed from footwell 20 and placed atop deck extension 24 adjacent the cushion mounting slide 50 to which web 64 is attached. Cushion arrangement 46 has been unfolded to that forward cushion 60 and rearward cushion 64 are now essentially flush with one another and resting atop deck extension 24 without overlapping each other. Optionally mounted to gunwale 70 of boat 10 is a side bolster 68 to provide additional comfort for a passenger seated atop cushion arrangement 46. Deck extension 24 of the opposite side of bow deck 12 may be similarly configured. Web 64 is preferably flexible enough to permit cushion arrangement 46 to lie either atop deck extension 24 as shown in FIG. 6, or on a floor 72 of footwell 20, as shown in FIG. 5. As forward cushion 60 may overlay hinge edges 34 and 38 of removable deck portion 18, it is desirable that these edges be generally flush with deck surface 58.

The sequence illustrated in FIGS. 2 to 6, above, for converting from a fishing configuration of bow deck 12 to a runabout configuration, may be reversed to convert bow deck 12 from runabout configuration to fishing configuration. As part of the conversion process, a forward fishing seat or leaning post may be inserted or removed from mount 26. A second cushion arrangement 46 may be included in footwell 20 so that seating positions may be configured atop both deck extensions 24. Cushion mounting slide 50 may slidably mate with a portion of web 64 of cushion arrangement 46 to permit cushion arrangements 46 to be removed from footwell 20 for storage or for long-term use of boat 10 in the fishing configuration shown in FIGS. 1 and 2.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A boat comprising:

a bow deck including an upper deck surface;

a footwell positioned between a pair of deck extensions on either side, the deck extensions each defining a seat for a passenger and including a rail adjacent the footwell, the footwell having a forward end and an open rear end;

a removable deck portion positioned across the footwell between the rails of the deck extensions, the removable deck portion having a front panel adjacent the forward end of the footwell and a rear panel adjacent the rear end of the footwell, the front and rear panels generally flush with the upper deck surface;

the deck portion being removable from the rails and hinged at a hinge line positioned between the front and rear panels of the deck portion, the front and rear panels of the deck portion being movable about the hinge line between a folded orientation and an unfolded orientation;

the forward end of the footwell including a recess for receiving and storing the deck portion when the deck portion has been removed from across the footwell, the deck portion being in the folded orientation while stored in the recess, the recess including slots formed in opposing sides of the footwell and sized to accommodate the front and rear panels in the folded orientation.

2. The boat of claim 1, wherein the folded deck portion is configured to be received within the recess of the forward end of the footwell so that no portion of the folded deck portion extends above the upper deck surface.

3. The boat of claim 1, wherein the opposing sides of the footwell are defined by port and starboard sidewalls of the footwell.

4. The boat of claim 1, further comprising a cushion arrangement movable between a first position atop one of the deck extensions when the deck portion is removed from the footwell and a second position on the floor of the footwell beneath the deck portion when the deck portion is positioned atop the rails.

5. The boat of claim 4, wherein the cushion arrangement is attached to a cushion mount on a side wall of the footwell by a web.

6. The boat of claim 4, wherein the cushion arrangement includes a forward cushion and a rearward cushion foldably attached to each other, the two cushions folding to fit within the footwell beneath the removable deck portion positioned between the rails of the deck extensions, and unfolding to lie generally flush with each other atop one of the deck extensions when the removable deck portion has been removed from atop the footwell.

* * * * *